United States Patent [19]

Hoff

[11] 4,035,954

[45] July 19, 1977

[54] GARAGE DOOR ASSEMBLIES

[76] Inventor: Ivar Hoff, 7080 Heimdal, Norway

[21] Appl. No.: 661,161

[22] Filed: Feb. 25, 1976

Related U.S. Application Data

[63] Continuation-in-part of Ser. No. 496,130, Aug. 9, 1974, abandoned.

[30] Foreign Application Priority Data

Aug. 24, 1973 Norway ..... 733340

[51] Int. Cl.[2] ..... E05D 15/40

[52] U.S. Cl. ..... 49/203; 49/279; 49/379

[58] Field of Search ..... 49/379, 197, 199, 200, 49/203, 204, 205, 206, 364, 265, 279

[56] References Cited

FOREIGN PATENT DOCUMENTS 109,236 6/1966 Norway ..... 49/379

*Primary Examiner*—Kenneth Downey

[57] ABSTRACT

Garage door assemblies having a frame for receiving a door mounted for over head swinging movement and a spring element as an energy storing member which compensates for at least a part of the weight of the door. For the transfer of the force of the spring element to the door, there is provided a lever system including a lever capable of pivoting between a first position in which the spring force has a low leverage and a second position in which the spring force has an increased leverage sufficient to provide a turning moment capable of swinging the door. The lever is retained in its first position by a releasable locking device.

6 Claims, 12 Drawing Figures

Figure 1:
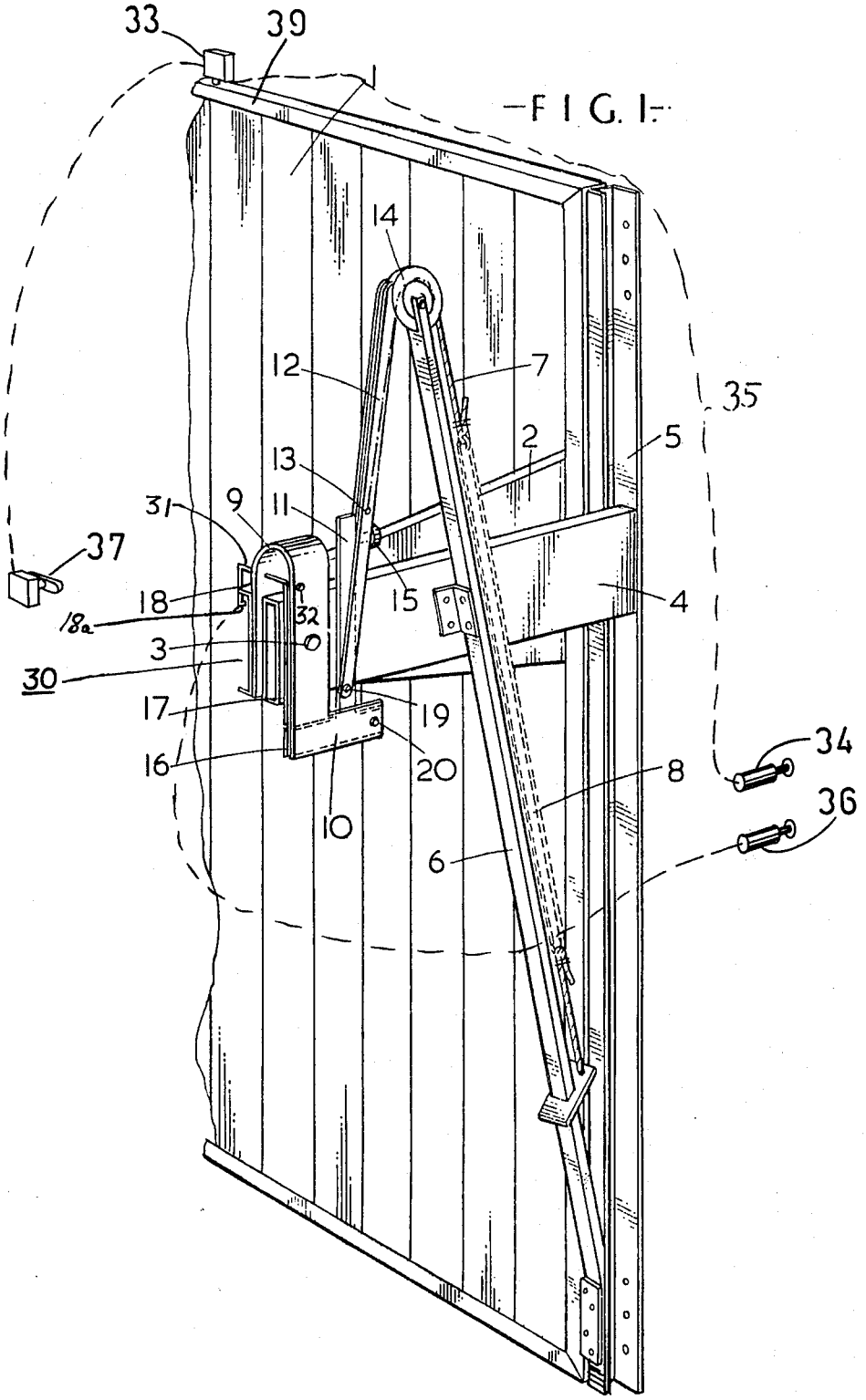

33
39
1

14
12
7
35
2
5
13
31
9
11
37
15
4
18
18a
32
3
30
17
19
16
20
8
34
36
10
6

-FIG. 2-

GARAGE DOOR ASSEMBLIES

CROSS REFERENCE TO RELATED APPLICATIONS

This application is a continuation-in-part of application U.S. Ser. No. 496,130, filed on Aug. 9, 1974 now abandonded.

BACKGROUND OF THE INVENTION

1. Field of Invention

This invention relates to garage door assemblies and more specifically to assemblies for opening and closing garage doors having a horizontal axis of swinging.

2. Description of the Prior Art

In the case of conventional manually operated garage door assemblies, the person who is going to drive a vehicle into or out of the garage has to leave the vehicle to open the garage door on arrival and to close the same door when leaving. This disadvantage is particularly serious when the garage door is to be operated by handicapped persons or busines vehicles.

Remote-controlled garage door assemblies are, of course, known but such assemblies usually depend upon power operation for lifting or lowering the door. Hence, the costs are so high that the use of such door assemblies is, in general, only reserved for special purposes.

However, door assemblies are known which can be remote-controlled without using a power supply. Such door assemblies have heretofore had to incorporate two springs, one acting as an energy storing member and the other compensating for a part of the weight of the door. This increases the cost of such door assemblies substantially compared with the conventional, manually operated door assemblies, as a number of additional parts are required in addition to a second spring.

SUMMARY OF THE INVENTION

The main object of the present invention is to provide door assemblies which can be remotely controlled on opening and closing without needing any power supply. In order to be trouble-free and cheap, it should be as simple as possible.

The invention is based upon the consideration that for each remote-controlled opening or closing of a garage door, a manually operated movement of the door is performed. Thus, after a remote-controlled opening on arrival, a manually operated closing can take place and prior to a remote-controlled closing on leaving, a manually operated opening can take place.

Figure 2:
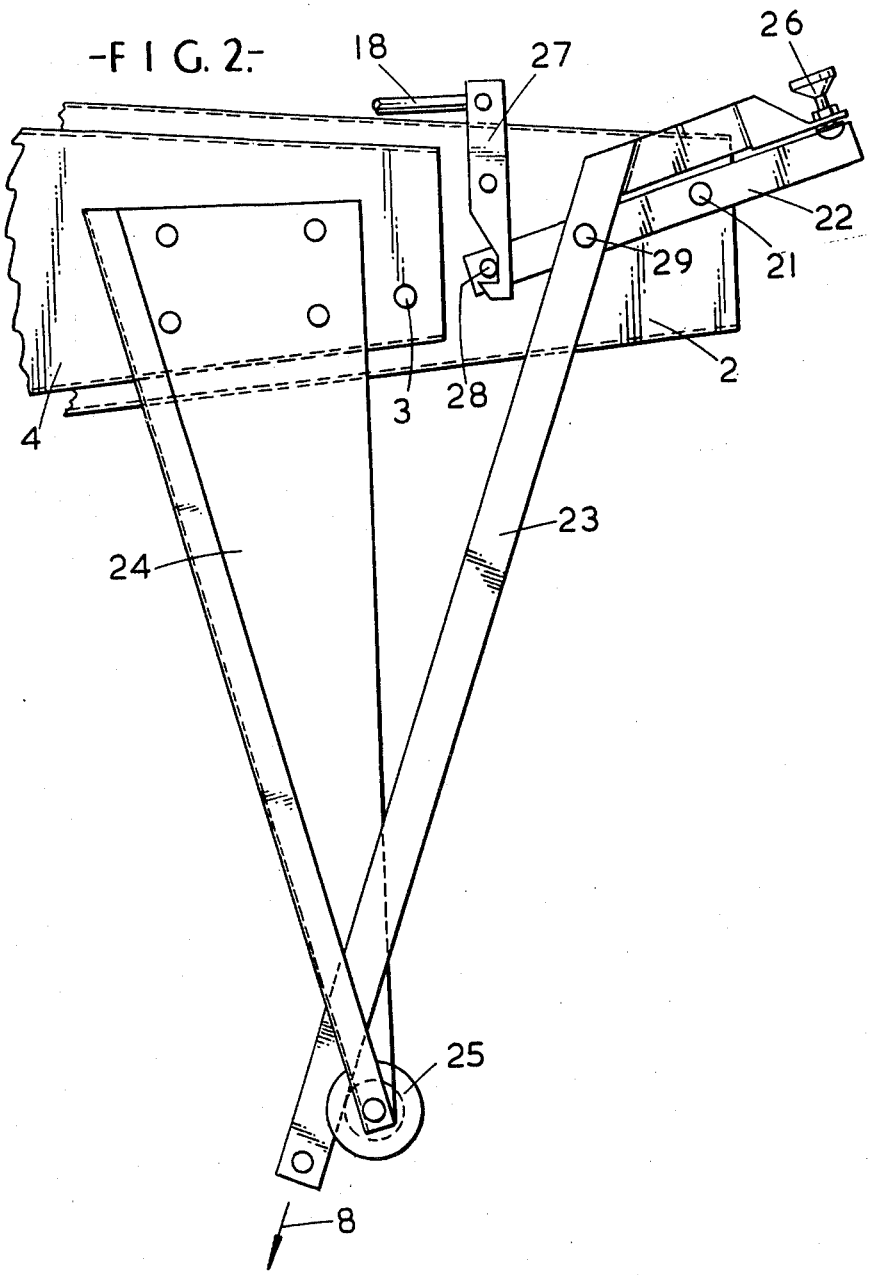
Figure 3:
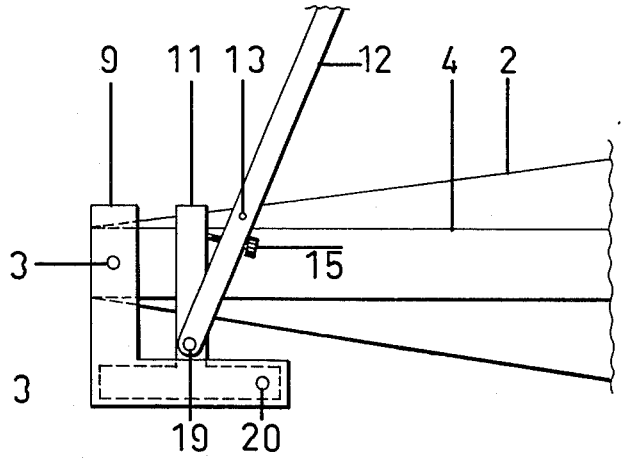
Figure 6:
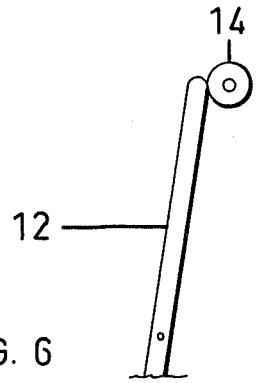
Figure 4:
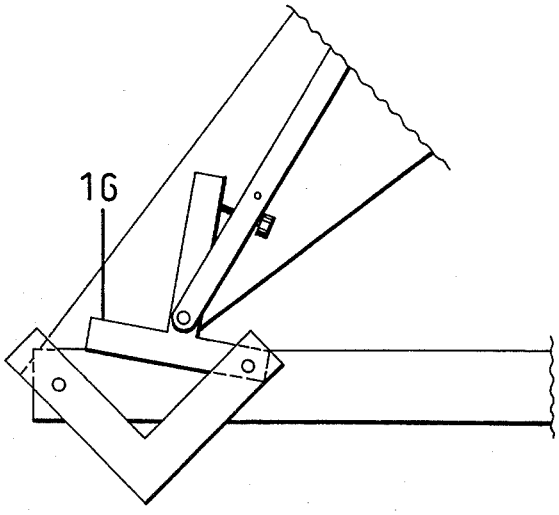
Figure 7:
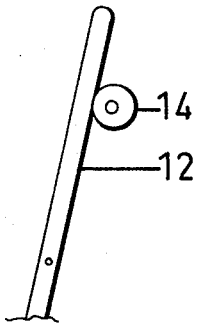
Figure 5:
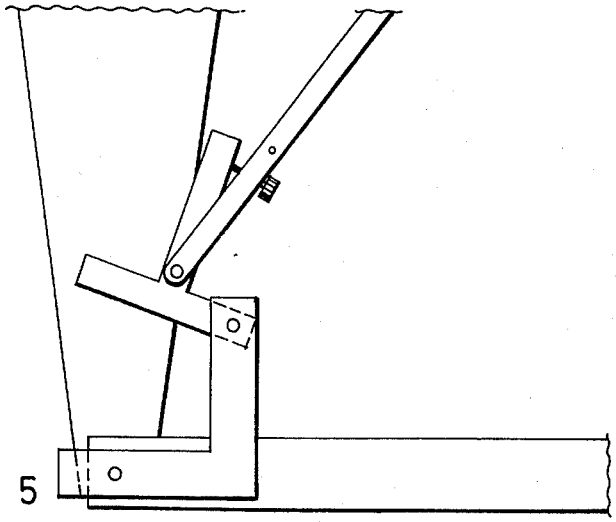
Figure 8:
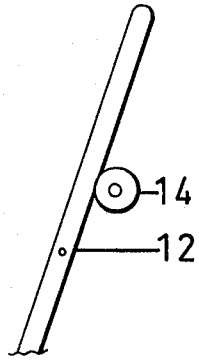
Figure 9:
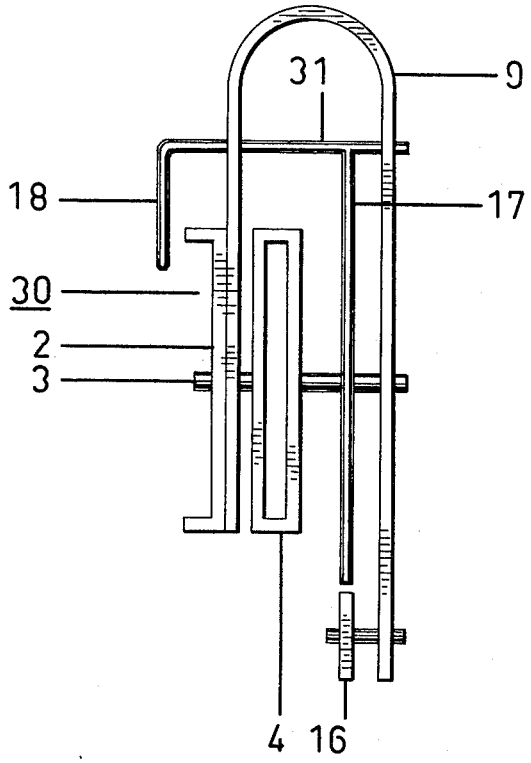
Figure 10:
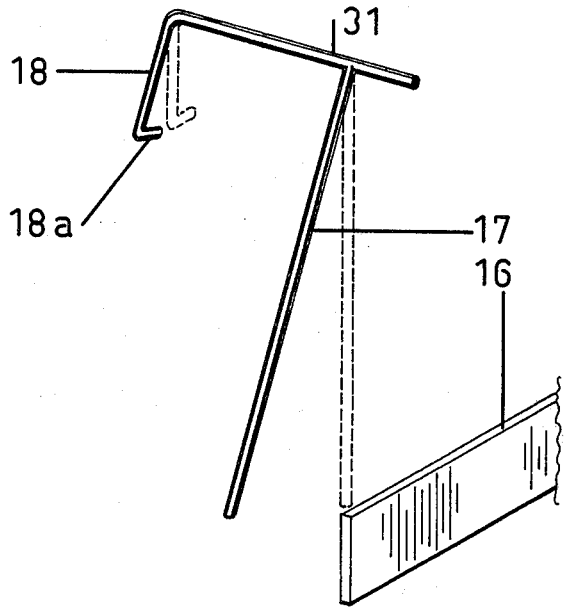
Figure 11:
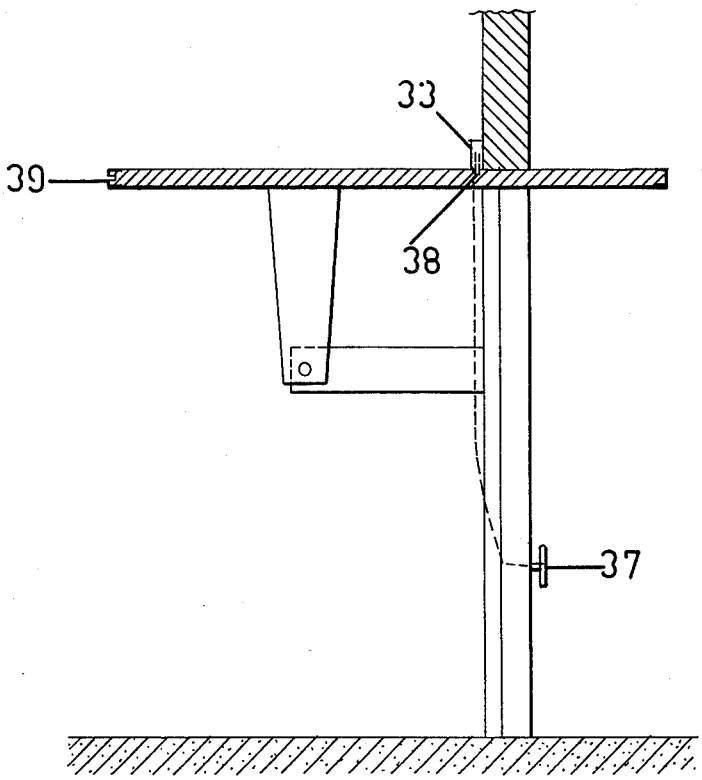
Figure 12:
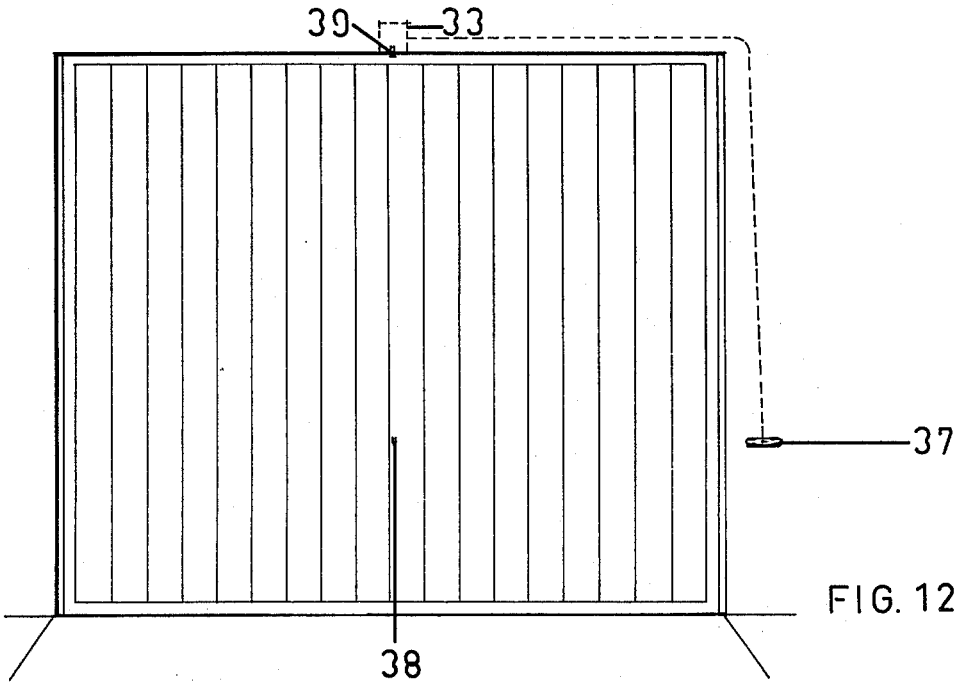

It has thus been found that a particularly advantageous door assembly may be provided which comprises a door mounted in a door frame for movement overhead, means to lock the door in its open and closed position, respectively, which can be released from a location outside the garage, at least one energy storing member, an intermediate member arranged between said energy storing member and the door to transfer the force from said energy storing member, said intermediate member being mounted for movement between a first position in which the force produces a moment which is too small to swing the door, and a second position in which the force is given greater leverage for acting on the door and a moment sufficient to move the door to the overhead position, and a remote-controlled locking device arranged to retain releasably said intermediate member in its first position. In order that the invention can be more clearly understood, convenient embodiments thereof will now be described, by way of example, with reference to the accompanying drawings in which:

FIG. 1 is a fragmentary perspective view of a first garage door assembly,

FIG. 2 is a fragmentary side view from the outer side of a second door assembly, FIGS. 3, 4 and 5 are fragmentary schematic representations of a lever system in the closed, intermediate and open positions of the garage door respectively, FIGS. 6, 7 and 8 are fragmentary schematic representations of the position of a lever of the lever system relative to a pulley in the respective closed, intermediate and open positions of the garage door, FIG. 9 is a schematic representation of a releasable locking device for the garage door, FIG. 10 is a schematic representation illustrating the mode of release of the locking device of FIG. 9, FIG. 11 is a side schematic representation of the garage door in the open position, and FIG. 12 is a front schematic representation of the garage door in the closed position.

DESCRIPTION OF CONVENIENT EMBODIMENTS

Referring to FIG. 1, a garage door assembly comprises a door 1 which is rigidly connected to a support arm 2 on each side, referred to below as the door arm. Each door arm 2 is swingably mounted on a further support arm 4 which is anchored to the side frame 5 of the door assembly projecting into the garage space. The door is swingable from the closed position of FIG. 1 into a position in which it is substantially horizontal in the upper part of the door opening with a portion projecting outside the garage.

While only one side of the assembly is illustrated, another corresponding set of support levers is arranged symmetrically with respect to the set of FIG. 1 but on the opposite side of the door. The additional components of the door assembly to be described below may, however, be provided on both sides of the door or only on one side, depending upon practical circumstances.

Between the support lever 4, referred to below as the frame lever, and the lowermost part of the side frame 5, a rod 6 is fixedly mounted to extend obliquely upwards and outwards from the securing position on the frame 5 to a location above the securing position on frame lever 4. At its upper end, rod 6 carries a pulley 14 for a wire 7 extending between an upper free end of a helical spring 8 and a point of engagement adjacent the door lever 2 which will be described in greater detail below. The lower end of spring 8 may be connected to the lower part of the rod 6 as shown in FIG. 1 or directly to the frame 5.

Door lever 2 is rigidly connected to a U-shaped member 9 disposed in an inverted position, one leg of which is fastened to the door lever 2 and the other leg of which is extended downwardly on the opposite side of the frame lever relative to the door lever 2. The other leg of the U member 9 is journalled on a bolt 3 which connects the door lever 2 and the frame lever 4 on each set of levers, and extends below the bolt to form an L-shape with leg portion 10 which extends substantially parallel to the door lever 2.

Between the end of the wire 7 opposite that connected to the helical spring 8 and the leg portion 10 is arranged a T-shaped member 11 which is pivotably attached to one end of its cross bar to the free end of leg portion 10 of the U-member 9 by a bolt 20. The wire 7 is connected to the T-member via a guide 12 in the form of two parallel bars or rails. At one end, the rails 12 are pivotably connected by bolt 19 to the main stem of the T-member 11 adjacent its cross bar. At the central part of the rails, the end of the wire 7 is connected to a bolt 13 connecting the rails. The other end of the rails 12 rests on the pulley 14 at the top of the rod 6, the wire 7 being suspended therebetween. The pivotal movement of the rails 12 in towards the main stem of the T-member 11 can be controlled by an adjusting screw 15 mounted on the rails to engage the main stem of the T-member 11.

The free end of the cross bar of the T-member 11 is used for locking the T-member in the shown position (see especially FIGS. 9 and 10). On the U-member 9, a locking device 30 is mounted for pivoting which comprises a locking arm 17, a releasing arm 18 the main portion of which extends in a plane parallel to the plane of the locking arm 17, and joining arms 17 and 18 an intermediate arm 31 journalled at 32 in the U-member 9 to define an axis for the pivotal movement of the locking device. In the active position illustrated in FIGS. 1 and 9, the locking arm 17 restricts pivoting of the T-member 11 relative to the U-member. In this position, the cross bar of the T-member 11 is engaged at both ends, namely at the bolt 20 and at the locking arm 17, and the leverage exerted by the spring force via the wire 7 is small.

Upon release of the locking device 30 by pivotal movement thereof via end 18*a* of the release arm 18 from the position shown in dotted lines to the position shown in full lines in FIG. 10, the T-member 11 pivots about the bolt 20 under the action of the force of the spring 8 which force is transferred through the bolt. By virtue of the adjusting screw 15 which thrusts against the main stem of the T-member 11, the rails 12 define an angle with the connection line between the bolts 19 and 20. This movement of the T-member 11 from a closed position of the door 1 (see FIG. 3), through an intermediate position (see FIG. 4) to an open position (see FIG. 5), means an increase in the leverage of the force of the spring and consequently in the turning moment acting on the door 1. The position of the pulley 14 relative to the rails 12 in each of the aforesaid closed, intermediate and open positions of the door 1 is illustrated in FIGS. 6, 7 and 8 respectively.

By appropriate dimensioning of the spring 8 and the different levers relative to the weight of the door 1, the following conditions can be obtained:

that the turning moment acting on the door when the T-member 11 is located in the locked position of FIG. 1 is too small to lift and swing the door, but sufficient to compensate for a substantial part of its weight;

that the turning moment acting on the door 1 when the T-member is released is sufficient, by virtue of the elongated arm, to swing the door upwards and beyond dead center which must occur for the operation of the weight of the door;

that the moment acting on the door in the last part of a free swinging (i.e. remote-released) closing movement is so small that the moment of inertia of the door guides the door completely back again.

Door assemblies according to the invention are provided with remotely releasable locking means 33 which can retain the door 1 in an open or closed position. Such locking means are known per se and can be designed in any suitable manner to permit release by a remotely located mechanism 34, e.g. from a position about 5 meters in front of the garage, by way of a cord pull 35 or from a sender inside a car. A corresponding mechanism 36 exists for acting on end 18*a* of the releasing arm 18. The locking means 33 acting directly on door 1 should also be operable by a handle 37 located on or adjacent the door on its outer side.

On manually opening and closing, the locking means 33 acting on the door 1 is released, therefore, by operating handle 37. The locking arm 17 will then retain the T-member 11 in the position shown in FIG. 1 and the turning moment due to the weight of the door will not be completely compensated for by the turning moment due to the force of the spring 8. This means that the door can be opened and closed manually in the ordinary way. Closing can be performed by remote control by releasing the locking means 33 keeping the door open.

Similarly, opening can be effected by remote control by releasing the locking device 30 and the locking means 33 keeping the door closed in a corresponding manner. In practice, all remote-controlled locking means can be released simultaneously by a signal which is interrupted during the movement of the door, for example by a common handle instead of mechanisms 34 and 36, which is released shortly after actuation.

Referring to FIG. 2, door lever 2 of this alternative embodiment is extended beyond the end of the frame lever 4. On the side of its free end, a bar 22 is pivotably mounted on a bolt 21 which is substantially parallel to the bolt 3, bolt 21 dividing the bar 22 into a shorter an a longer part. Approximately in the middle of the longer part, which points towards the door (not shown), a rod 23 is pivotably connected and inclined so that its downwardly depending end is connected to the spring 8. To the frame lever 4 there is secured a downwardly depending bracket 24 supporting at its lower edge a wheel 25 which the rod 23 rests against with its lower face. The rod 23 extends beyond the upper side of the bar 22 and is provided with an adjusting screw 26 which acts against the shorter part of the bar 22.

The end of the longer part of the bar 22 can be locked in an uppermost position by means of a locking arm 27 being caused to engage a stud 28. The connection between the rod 23 and the bar 22 is a bolt 29 extending substantially parallel to the swinging axis of the door.

While the embodiment of FIG. 2 operates in a similar manner to the embodiment of FIG. 1, it should be realised that the counterparts of the T-shaped member 11, locking arm 17, bolt 19 and bolt 20 in the assembly of FIG. 1 are respectively bar 22, locking arm 27, bolt 29 and bolt 21 in the assembly of FIG. 2. Moreover, the extended portion of lever 2 in FIG. 2 renders U-member 9 of FIG. 1 redundant.

The invention also contemplates alternatives not specifically mentioned above in which the door may be mounted in other ways than as shown, e.g. with linkages and guiding rollers or similar structures already known for the purpose of mounting garage doors, and in which the compensating and energy storing action may be provided for in other ways, e.g. with counterweights, supplementary springs, compressible fluid elements etc.. Further the invention is not confined to the employment of an under-compensated door since an over-compensated door may also be used. In this instance release of locking arm 17 or 27 will then lead to a closing of the door.

The embodiments of FIGS. 1 and 2 of the invention have the following cycle of operation:

1. The door is first opened manually and locked in the open position by locking means 33 enaging door recess 38 (see FIG. 11);

2. After having removed the vehicle from the garage, the locking means 33 is released by remote control to close the door; 3. Upon arrival at the garage, the locking means 33 keeping the door 1 closed by engaging door recess 39 (see FIG. 12) and the locking arm 17 (or 27) of the locking device are remote released to allow the door to swing open.

4. After placing the vehicle in the garage, the door 1 is manually closed. The T-member 11 or the bar 22 will then be urged by their adjusting screws 15 or 26 to take the position shown in FIGS. 1 or 2. By setting the adjusting screws, the T-member 11 or the corresponding bar 22 can be caused to reach this position shortly before the door reaches its closed position. This means that the locking arm 17 or 27 will not engage the adjacent part of the T-member 11 or the bar 22 when the door is closed. The force necessary to swing the locking arm 17 or 27 will thus be small.

I claim:

1. A garage door assembly comprising in combination: a frame means for receiving a door mounted for overhead swinging movement and for providing rigid support for door suspension and opening and closing levers; a single spring element designed for extension between spaced apart points and having one end thereof secured to the frame means; a pivotable door support member secured to said door; a pivotable lever system connected to an opposite and remaining free end of said spring element and operatively associated with said pivotable door support member to enable said spring element to furnish torque for either opening or closing the door by pivotally moving said lever system so as to alter the leverage ratio; and a releasable locking device adapted to cooperate in its locked position with said lever system substantially to prevent pivotal movement thereof from a closed door position to an open door position or vice-versa.

2. A garage door assembly comprising in combination: a frame means for receiving a door mounted for overhead swinging movement and for providing rigid support for door suspension and opening and closing levers; a single spring element designed for extension between spaced apart points and having one end thereof secured to the frame means; a system of levers comprising at least first and second levers connected together in series, said first lever being connected to an opposite and remaining free end of said spring element, being mounted for restrained movement in one direction as restrained by a releasable locking device as well as for unrestrained pivotal movement in an opposite direction and being pivotally mounted at a location spaced from said locking device to provide pivotal support for said second lever which is itself pivotally mounted between its opposite ends; a pivotable door support member secured to said door and operatively associated with said lever system to enable said spring element to furnish torque for either opening or closing the door by pivotally moving said levers of said system to and fro thereby altering the leverage ratio; and said releasable locking device being adapted to cooperate in its locked position with said second lever substantially to prevent pivotal movement thereof from a position in which the door is closed to a position in which the door is open or vice-versa.

3. The assembly of claim 2, wherein the first lever has the free end of the spring element secured at an intermediate position along its length and has an end spaced from said releasable locking device providing the pivotal support for the second lever which is formed with an offset flange member, the system of levers comprising a third lever having an offset end portion with its terminal end pivotally mounted on an end portion of said offset flange member, and the door support member being mounted and supported by said third lever which is itself mounted at an intermediate position thereof for pivotal movement on the frame means, locking of the locking device also substantially preventing pivoting of said third lever.

4. The assembly of claim 2, wherein the second lever has a pivotal axis substantially parallel to the pivotal axis of the door support member, the point of action of the force of the spring element on said second lever being located at the pivotal connection of the first lever to the second lever and between said axes when the second lever is locked.

5. The assembly of claim 3, wherein the frame means includes a rigidly mounted rod extending obliquely upwards from a first mounting position to a location above a second mounting position, and a rigidly mounted frame support member projecting laterally of a vertical side frame member and being secured to said rod at said second mounting position, said rod supporting at its upper end a pulley, the spring element having its one end secured to the lower end of the rod and its free end secured to cord means passing over said pulley to be secured at the intermediate position along the length of the first lever, the first lever having its upper end resting against the pulley and its lower end pivotally connected to the second lever which is in the form of a T-shaped member, the correction being on the main stem of said T-member adjacent its cross bar, an adjusting screw mounted on said first lever adjacent its intermediate position to engage said main stem and control pivotal movement of said first lever in towards said main stem, the door support member projecting laterally of said vertical side frame member alongside but spaced from said frame support member, a U-shaped member arranged in an inverted position and constituting the third lever, one leg of the U-member being secured on its external face to said door support member, the internal faces of the two legs straddling said frame support member at a position thereof remote from said vertical side frame member and said U-member being pivotally mounted on a pivot interconnecting said frame support and door support members, the other of the two legs of the U-member extending below said pivot to form an L-shape with a portion of said leg extending substantially parallel to said door support member, said leg portion being pivotally connected adjacent its free end to one end of said cross bar of the T-member, the releasable locking device comprising a locking arm, a releasing arm the main portion of which extends in a plane parallel to the locking arm and joining said locking and releasing arms an intermediate arm journalled in the U-member to define an axis for the pivotal movement of said locking device, the relative disposition of the other and free end of said cross bar of the T-member and the locking arm being such as to restrict pivotal movement of the T-member relative to the U-member when said locking arm is in its active position so that the leverage exerted by the force of said spring element is small, said releasing arm being adapted to be actuated by remote control means to cause release of the locking device by pivotal movement thereof relative to said U-member whereby the T-member pivots under the action of the force of said spring element about said one end of its cross bar and the resulting movement gives rise to a substantial increase in the leverage exerted by said spring element and hence in the turning moment acting on said door.

6. The assembly of claim 2, wherein the door support member and a frame support member of the frame means both project laterally of a vertical side frame member alongside but spaced from each other, said door support member being pivotally mounted on said frame support member and having a portion extending beyond the end of the latter, said extension portion of said door support member supporting adjacent its free end a pivot for the second lever which divides said lever into a shorter portion which projects beyond said extension portion and a longer portion divided by a pivot mounted approximately centrally of said extension portion and interconnecting the first and second levers, and stud means located adjacent the free end of said longer portion, the releasable locking device comprising a locking arm pivotally mounted on said door support member and adapted to engage when its active position said stud means to restrict pivotal movement of said door support member relative to said frame support member so that the leverage exerted by said spring element is small, and a releasing arm mounted on said locking arm in a plane parallel but substantially at right angles thereto, said releasing arm being adapted to be actuated by remote control means to cause release of said locking arm from said stud means whereby the second lever pivots under the action of the force of said spring element and the resulting movement gives rise to a substantial increase in the leverage exerted by said spring element and hence in the turning moment acting on said door.

* * * * *